US005484296A

United States Patent [19]

Taylor

[11] Patent Number: 5,484,296

[45] Date of Patent: Jan. 16, 1996

[54] ELECTRICAL CONNECTOR APPARATUS

[75] Inventor: Michael A. Taylor, Annapolis, Md.

[73] Assignee: Westinghouse Electric Corporation, Pittsburgh, Pa.

[21] Appl. No.: 194,893

[22] Filed: Feb. 14, 1994

[51] Int. Cl.[6] ..... H01R 13/44

[52] U.S. Cl. ..... 439/140; 439/669

[58] Field of Search ..... 439/137–140, 439/131, 188, 668, 669, 199, 201

[56] References Cited

U.S. PATENT DOCUMENTS

| | | | |
|---|---|---|---|
| 1,901,040 | 3/1933 | Peroni et al. | 439/669 |
| 3,291,926 | 12/1966 | Nelson | 439/669 |
| 3,995,209 | 11/1976 | Weston | 439/140 |
| 5,171,158 | 12/1992 | Cairns | 439/199 |

FOREIGN PATENT DOCUMENTS

| | | | |
|---|---|---|---|
| 2059081 | 6/1971 | Germany | 439/140 |

*Primary Examiner*—Gary F. Paumen
*Assistant Examiner*—Hien D. Vu

[57] ABSTRACT

A male plug for an underwater electrical connector wherein a movable rod is contained within a plug housing to exclude the ambient water medium in order to protect the internal electrical contacts. When coupled with a complementary female receptacle, the rod can be extended into the receptacle and first and second sets of electrically connected spaced apart contacts on the rod establish electrical communication between electrical conductors of the receptacle and electrical conductors of the plug respectively.

6 Claims, 3 Drawing Sheets

ELECTRICAL CONNECTOR APPARATUS

BACKGROUND OF THE INVENTION

1. Field of the Invention

The invention in general relates to electrical connectors, and more particularly, to an electrical connector which can be used and mated in the underwater environment.

2. Description of Related Art

Various underwater electrical connectors are available for electrically connecting two cables, each of which includes one or more electrical conductors. Some connectors include pin and socket arrangements which, when in an unmated condition expose the electrically conducting elements to the ambient water medium. In a water environment, over an extended period of time, the exposed pin and socket elements may be subject to breaking, contamination buildup, underwater creature destruction and electrical shorting.

To obviate these undesirable hazards, a connector has been produced wherein the female receptacle portion of the connector has an arrangement which totally excludes the ambient water medium, when in an unmated condition with a complementary plug. Although this design significantly advances the state of the art, a probe portion of the plug has exposed contacts which are subject to all of the above undesirable hazards.

The present invention provides for an improved male plug whereby all electrical elements are protected from the ambient medium when the plug and receptacle of the connector are in an unmated condition.

SUMMARY OF THE INVENTION

The probe of the present invention is operable with a complementary female receptacle of the type which excludes the surrounding ambient medium when in an unmated condition. The plug includes a housing which has an electrically insulated inner body and a means for coupling the plug to the receptacle. The electrically insulating inner body has an elongated cylindrical chamber therethrough which aligns with a similar cylindrical chamber within the female receptacle, when the plug and receptacle are coupled together.

A rod is provided and is positioned within the cylindrical chamber of the plug and is movable from outside of the plug housing. This rod includes at least first and second spaced apart contacts on the surface thereof, with the contacts being electrically connected to one another. At least one electrical contact is provided on the inner surface of the cylindrical chamber of the plug as well as on the inner surface of the cylindrical chamber of the receptacle. Plug and receptacle cables each include at least one electrical conductor respectively connected to these latter contacts.

The plug includes means for moving the rod after the plug and receptacle are coupled together so as to displace a stopper occupying the cylindrical chamber within the receptacle such that the first contact on the rod engages the electrical contact on the inner surface of the chamber of the receptacle. The distance between the first and second contacts on the rod is such that when so engaged, the second contact engages the electrical contact on the inner surface of the chamber of the plug, thereby making electrical contact between the plug and receptacle cables.

DESCRIPTION OF THE PREFERRED EMBODIMENT

Figure 1:
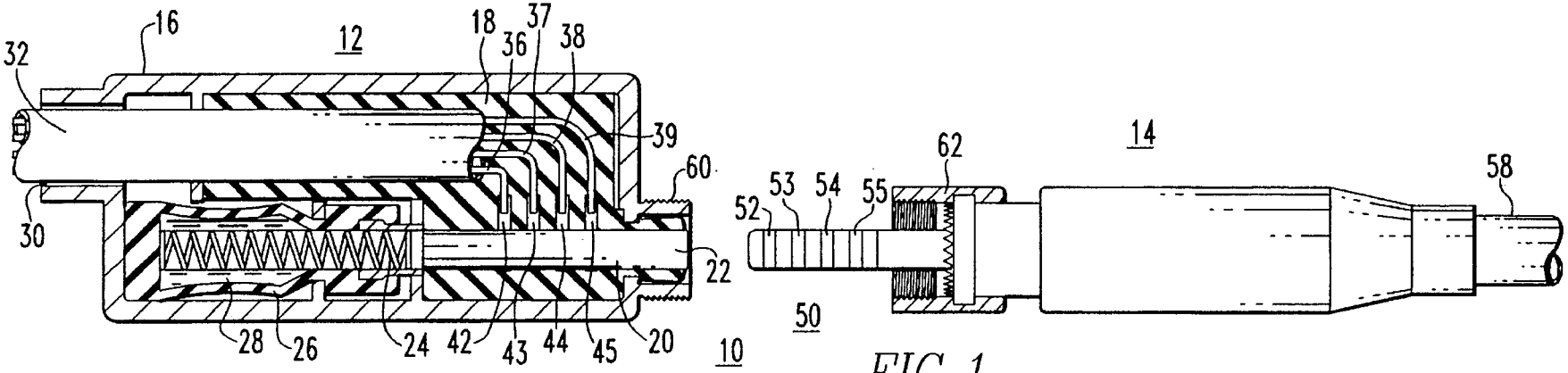
FIG. 1 PRIOR ART
FIG. 1 illustrates, partially in cross section, an underwater electrical connector of the prior art, in an unmated condition.

In FIG. 1 there is illustrated an underwater electrical connector 10 comprised of a female receptacle 12 and a male plug 14. The receptacle 12 includes a housing 16 made of an engineering plastic such as polycarbonate and contains therein a molded inner body 18 such as rubber.

Formed within the inner body 18 is an elongated cylindrical chamber 20 which is occupied by a stopper 22 when the plug and receptacle are unmated.

The stopper 22 is movable against the action of a spring 24 positioned within a flexible pressure compensated bladder 26 filled with a dielectric fluid 28. Pressure compensation is accomplished by virtue of the passageway 30 between the housing 16 and electrical cable 32, such that the surrounding ambient water medium enters the interior of housing 16 and applies pressure to the bladder 26.

The electrical cable 32 includes at least one electrical conductor, and for purposes of illustration, four such conductors 36–39 are illustrated. These conductors are electrically connected to respective ring contacts 42–45 positioned on the inner surface of the cylindrical chamber 20. It is seen therefore that when the connector is in an unmated condition, the contacts 42–45 are completely isolated and protected from the surrounding ambient medium.

Plug 14 includes a probe 50 having on the surface thereof ring contacts 52–55 which are electrically connected to individual conductors in plug cable 58.

Figure 1A:
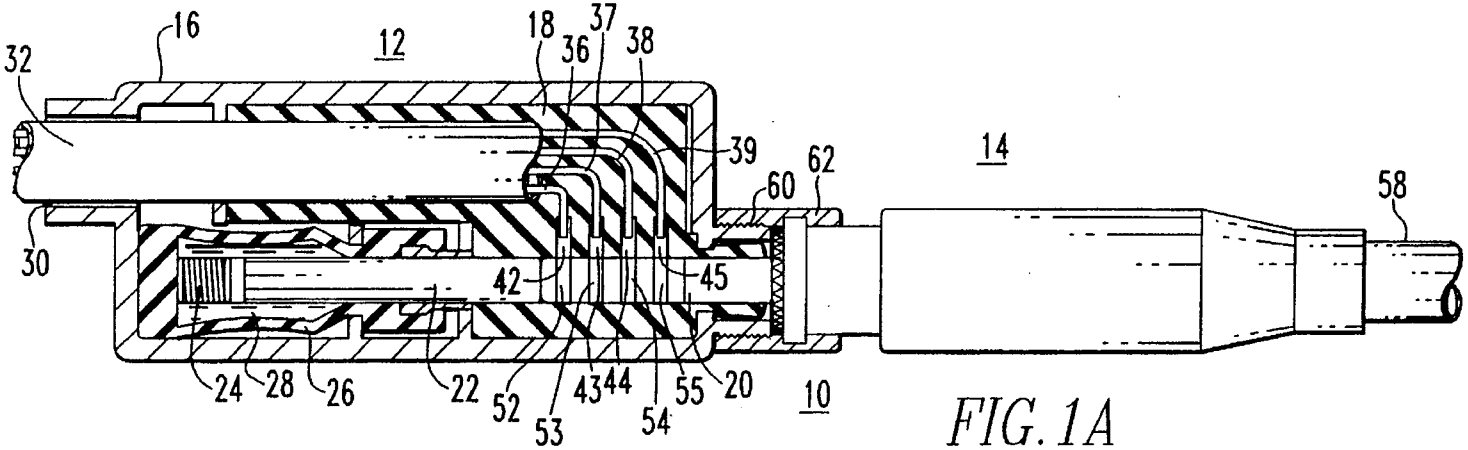
FIG. 1A PRIOR ART
FIG. 1A illustrates the components of FIG. 1 in a mated condition.

Housing 16 of receptacle 12 can include a threaded extension 60 which, in conjunction with the lock nut 62 on plug 14 serves to positively couple the plug and receptacle together. In so coupling, probe 50 of plug 14 displaces the stopper 22 such that when fully inserted, contacts 52–55 on probe 50 electrically connect with respective contacts 42–45 on the inner surface of chamber 20 of receptacle 12, as illustrated in FIG. 1A. Additionally, FIG. 1A shows stopper 22 displaced partially into bladder 26 against the action of spring 24. When the parts are unmated, compressed spring 24 will force stopper 22 to once again be positioned as illustrated in FIG. 1.

Figure 2:
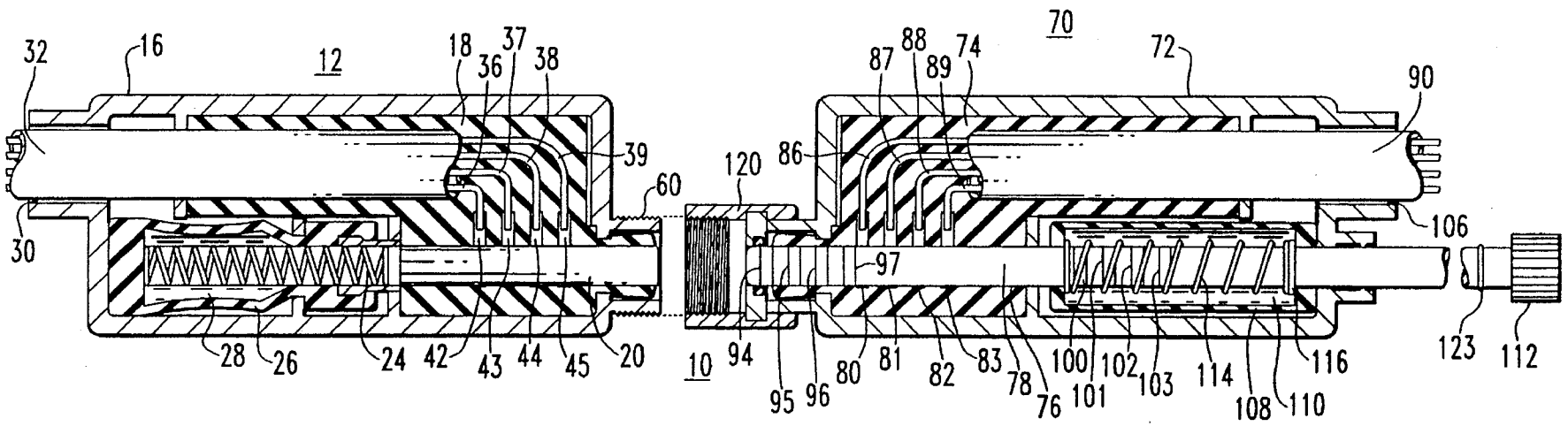
FIG. 2 illustrates, partially in cross section, underwater electrical connector apparatus in accordance with the present invention in an unmated condition.

Although the contacts of the receptacle 12 are protected against contamination buildup, underwater creature destruction and shorting, the unprotected male probe is still subject to these detrimental hazards of the underwater environment and is additionally subject to potential breaking. FIG. 2 illustrates one embodiment of the present invention in which the male plug and probe are fully protected against the elements.

In FIG. 2 the male plug 70 is operable in conjunction with the female receptacle 12 previously described in FIG. 1. Plug 70 includes a housing 72, such as polycarbonate, having contained therein a molded inner body 74 of a material such as rubber. The inner body 74 includes an elongated cylindrical chamber 76 having a rod 78 therein movable from outside of the housing 72.

At least one ring contact is provided on the inner surface of chamber 76 and, as illustrated in FIG. 2, four such contacts 80–83 are provided. These contacts are respectively connected to electrical conductors 86–89 of plug cable 90.

Rod 78 includes at least first and second spaced apart contacts on the surface thereof and for the embodiment illustrated, a first set of four contacts 94–97 are spaced from a second set of four contacts 100–103. Contacts 94–97 are electrically connected to respective contacts 100–103 such as by conductors internal to rod 78.

The inside of housing 72 is open to the ambient water medium by virtue of passageway 106 between the housing 72 and plug cable 90 and accordingly for pressure compensation purposes a flexible bladder 108, filled with a dielectric fluid 110, is provided. Rod 78 passes through this bladder 108 and extends outside of housing 72 and is longitudinally movable with the provision of a knob 112. Movement of the knob to the left, as illustrated in FIG. 2, is against action of a spring 114 which bears against flange 116 around the periphery of rod 78.

Means are provided for joining the receptacle and plug together and include lock nut 120 which couples with threaded extension 60 of receptacle 12, although other means for coupling the two components together may be provided.

Figure 2A:
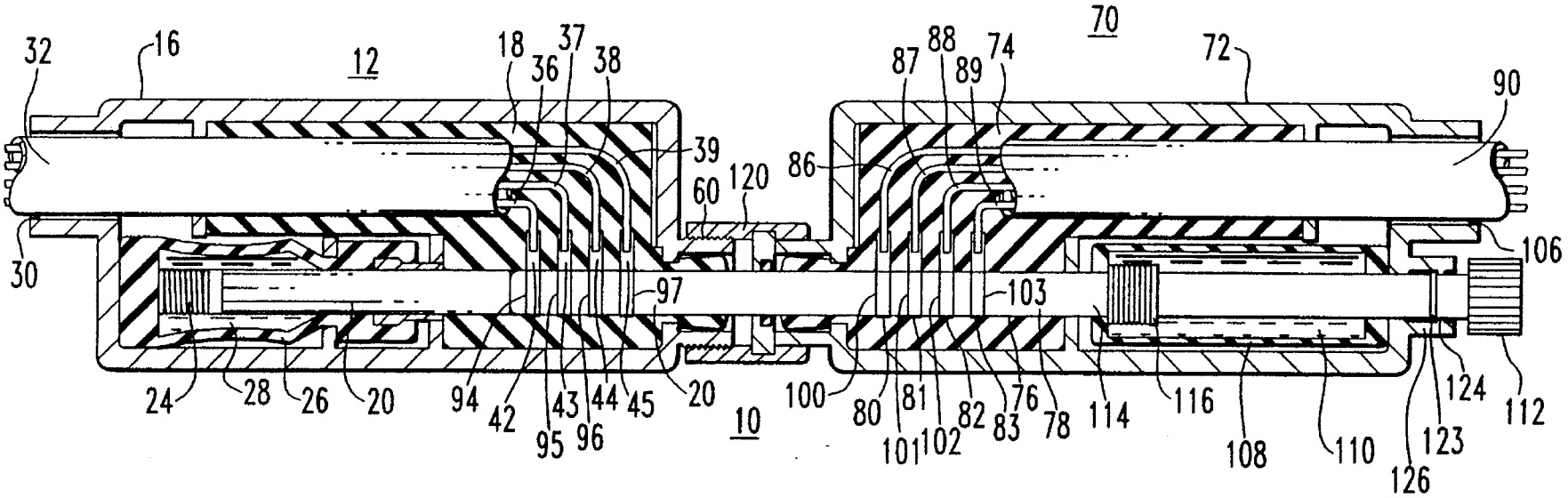
FIG. 2A illustrates the components of FIG. 2 in a mated condition.

When the receptacle 12 and plug 70 are coupled together, rod 78 may be manually moved to the position illustrated in FIG. 2A so as to displace stopper 22 such that the first set of contacts 94–97 on the surface of rod 78 electrically connect with ring contacts 42–45 of receptacle 12. Provisions for moving rod 78 to displace stopper 22 other than by manual means may be provided. The second set of contacts 100–103 on rod 78 are disposed at a particular distance from the first set of contacts such that electrical connection is made with ring contacts 80–83 within plug 70, thereby establishing electrical connection between receptacle cable 32 and plug cable 90.

In order to secure the rod 78 in position against action of spring 114, a latching means is provided and in one embodiment the latching means may take the form of a peripheral protrusion 123 on the surface of rod 78 which will snap into place and will be held in position by means of complementary peripheral protrusion 124 built into housing extension 126.

When the parts are to be unmated, rod 78 may be manually withdrawn from receptacle 12 by pulling on knob 112 to thereby again occupy chamber 76 of plug 70 to fully protect the contacts against the hazards of the ambient water medium when the receptacle and plug are uncoupled.

I claim:

1. In an underwater electrical connector having a male plug and a female receptacle, which receptacle includes an electrically insulating inner body having an elongated cylindrical chamber extending therethrough, a spring loaded stopper occupying said chamber when said plug and said receptacle are unmated to exclude the surrounding ambient medium and adapted to move in said chamber against action of said spring when said plug and said receptacle are mated, at least one electrical contact on the inner surface of said chamber, a receptacle cable having at least one electrical conductor connected to said contact, and a fluid-containing pressure compensation bladder into which said stopper may move, said plug comprising:

a) a plug housing including an electrically insulating inner body;

b) locking means for coupling said plug and said receptacle together;

c) said electrically insulating inner body of said plug housing having an elongated cylindrical chamber therethrough which aligns with the cylindrical chamber of said receptacle when said plug and receptacle are coupled together;

d) a rod positioned within said cylindrical chamber of said plug and being moveable outside of said plug housing;

e) said rod including at least first and second spaced apart contacts on the surface thereof, with said contacts being electrically connected to one another;

f) at least one electrical contact on the inner surface of said cylindrical chamber of said plug;

g) a plug cable mounted in said plug housing and having at least one electrical conductor connected to said latter contact;

h) means at one end of said rod for moving said rod, after said plug and receptacle are coupled together, to displace said stopper such that said first contact on said rod engages said electrical contact on the inner surface of said chamber of said receptacle, with the distance between said first and second contacts on said rod being such that when so engaged, said second contact engages said electrical contact on the inner surface of said chamber of said plug thereby making electrical connection between said plug and receptacle cables; and i) said locking means being so constructed and arranged so as to exclude the surrounding ambient medium from contacting any of said contacts on said rod during mating and unmating of said receptacle and plug.

2. Apparatus according to claim 1 wherein:

said rod extends outside of said plug housing.

3. Apparatus according to claim 2 which includes:

a knob on the end of said rod to enable said rod to be manually moved.

4. Apparatus according to claim 3 which includes:

latch means for latching said rod in position after displacing said stopper.

5. In an underwater electrical connector having a male plug and a female receptacle, which receptacle includes an electrically insulating inner body having an enlongated cylindrical chamber extending therethrough, a spring loaded stopper occupying said chamber when said plug and said receptacle are unmated to exclude the surrounding ambient medium and adapted to move in said chamber against action of said spring when said plug and said receptacle are mated, at least one electrical contact on the inner surface of said chamber, a receptacle cable having at least one electrical conductor connected to said contact, and a fluid-containing pressure compensation bladder into which said stopper may move, said plug comprising:

a) a plug housing including an electrically insulating inner body;

b) locking means for coupling said plug and said receptacle together;

c) said electrically insulating inner body of said plug housing having an elongated cylindrical chamber therethrough which aligns with the cylindrical chamber of said receptacle when said plug and receptacle are coupled together;

d) a rod positioned within said cylindrical chamber of said plug and extending outside of said plug housing and being moveable outside of said plug housing;

e) said rod including at least first and second spaced apart contacts on the surface thereof, with said contacts being electrically connected to one another;

f) at least one electrical contact on the inner surface of said cylindrical chamber of said plug;

g) a plug cable mounted in said plug housing and having at least one electrical conductor connected to said latter contact;

h) means at one end of said rod for moving said rod, after said plug and receptacle are coupled together, to displace said stopper such that said first contact on said rod engages said electrical contact on the inner surface of said chamber of said receptacle, with the distance between said first and second contacts on said rod being such that when so engaged, said second contact engages said electrical contact on the inner surface of said chamber of said plug thereby making electrical connection between said plug and receptacle cables;

i) a knob on the end of said rod to enable said rod to be manually moved;

j) latch means for latching said rod in position after displacing said stopper.

k) a spring surrounding said rod;

l) a flange on said rod against which said spring bears;

m) said spring being operable to retract said rod into said chamber of said plug when said means for latching is unlatched.

6. Apparatus according to claim 1 wherein:

a) said receptacle includes a plurality of contacts on the inner surface of said chamber; and b) said rod includes a first and second plurality of contacts on the surface thereof, with the contacts of said first plurality being electrically connected to the contacts of said second plurality and being spaced therefrom.

* * * * *